US007086400B2

(12) United States Patent
Shigematsu et al.

(10) Patent No.: US 7,086,400 B2
(45) Date of Patent: Aug. 8, 2006

(54) MASK

(75) Inventors: Nobuo Shigematsu, Tokyo (JP); Kenichi Ono, Saitama-ken (JP); Shuichiro Shimada, Saitama-ken (JP)

(73) Assignee: Shigematsu Works Co., Ltd., Tokyo (JP)

( * ) Notice: Subject to any disclaimer, the term of this patent is extended or adjusted under 35 U.S.C. 154(b) by 39 days.

(21) Appl. No.: 10/428,070

(22) Filed: May 2, 2003

(65) Prior Publication Data

US 2003/0205231 A1 Nov. 6, 2003

(30) Foreign Application Priority Data

May 2, 2002 (JP) ..... 2002-130580

(51) Int. Cl.
*A62B 18/02* (2006.01)
*A62B 18/08* (2006.01)

(52) U.S. Cl. ..... 128/205.25; 128/206.24

(58) Field of Classification Search ..... 128/205.27, 128/205.29, 206.12, 206.13, 206.14, 206.16, 128/206.17, 206.18, 206.19, 206.21, 206.24, 128/206.25, 206.26, 206.28, 207.11, 207.13, 128/201.23

See application file for complete search history.

(56) References Cited

U.S. PATENT DOCUMENTS

| | | | | | |
|---|---|---|---|---|---|
| 537,678 | A * | 4/1895 | Detourbe | ..... | 128/206.16 |
| 1,502,450 | A * | 7/1924 | Wood | ..... | 128/206.13 |
| 1,946,334 | A * | 2/1934 | Schwartz | ..... | 128/206.16 |
| 2,176,380 | A * | 10/1939 | Schwartz | ..... | 128/206.16 |
| 2,201,315 | A * | 5/1940 | Lehmberg | ..... | 128/206.16 |
| 3,521,630 | A * | 7/1970 | Westberg et al. | ..... | 128/206.15 |
| 4,856,509 | A * | 8/1989 | Lemelson | ..... | 128/206.19 |
| 5,003,633 | A * | 4/1991 | Itoh | ..... | 2/9 |
| D366,697 | S * | 1/1996 | Drummond | ..... | D24/110.2 |
| 6,055,982 | A * | 5/2000 | Brunson et al. | ..... | 128/206.12 |
| 6,196,223 | B1 * | 3/2001 | Belfer et al. | ..... | 128/206.25 |
| 6,609,516 | B1 * | 8/2003 | Hollander et al. | ..... | 128/201.17 |

* cited by examiner

*Primary Examiner*—Teena Mitchell
(74) *Attorney, Agent, or Firm*—Sherman & Associates

(57) ABSTRACT

A mask comprising a mask main body and a face seal, wherein the outer periphery part of the main body and the outer periphery part of the face seal are adhered, said face seal is composed of a sheet prepared by laminating soft resin such as polyurethane resin on one surface of elastic fabric made of nylon or polyester fibers, and said laminated sheet is cut off to have a modified ring shape.

1 Claim, 2 Drawing Sheets

MASK

BACKGROUND OF THE INVENTION

1. Field of the Invention

The present invention relates to a mask used in daily life, having a face seal which fits to the face of the mask wearer. Especially, the present invention relates to the mask having a face seal which eliminates the gap between the covering portion for mouth and nose of the mask and the face.

2. Description of the Prior Art

In general, a mask can be classified mainly into two types. One is a mask used for the hygienical purpose. This type is used in food industries or precision machinery industries where high cleanness is required, further, this type is used for the medical use or for the hygienical use in daily life. Another one is a mask for industrial use, which is used for the work in a dusty environment. The mask of the present invention is covering all of above mentioned fields. The main body of a mask is made of a sheet type filter such as gauze or non-woven cloth. Or, sheet type filter such as gauze or non-woven cloth is inserted into the inside of the main body of the mask. And the mask is fixed to the human's face by hanging head harness to ears so as to cover human's nose, mouth and chin. Since the shapes of human's face are various, many ideas are contrived to fit a mask to various shapes of human's face up to the present. For example, a method to stamp out the sheet shape material of less elasticity and to form it to the shape so as to cover human's mouth and nose can be mentioned. However, although this method can reduce the manufacturing cost of a formed product to lower level, the shape of the product is flat and is difficult to fit it to ups and downs of face, and the reliable fitting with the human's face can not be obtained. As the improved method, the following method is proposed. That is, the metal parts made of soft aluminum or the like is adhered to the sheet filter, and makes it fit to the ups and downs of each individual's face by bending said metal parts, in particular, around the nose part which has considerable uneven ups and downs. This method is usually applied to the relatively cheap mask, for example, a disposable type dust mask or other simplified masks. Since said type mask uses metal parts, it is necessary to separate the metal parts from the mask when it is disposed of as a waste product, and this is the troublesome problem to be pointed out. As the most popular method, the method to use a material which has rubber elasticity and to form a mask stereographically can be mentioned. This method is mainly applied to an expensive mask manufacturing, such as a replaceable dust mask or a gas mask. However, the rough shapes of these masks are almost fixed, therefore, it is necessary to prepare plural mask sizes suited to various face sizes.

OBJECT OF THE INVENTION

The inventors of the present invention have carried out intensive study to develop a mask which tightly covers the face of mask wearer, especially tightly covers the mouth surroundings and the nose having ups and downs using cheap materials, further to develop a mask with a face seal of good air tight and allowing non-restricted motion of the mouth. Consequently, the inventors of the present invention have accomplished the present invention, and the object of the present invention is to provide a mask possessing a face seal which is tightly fitted to the face of a person who puts it on.

BRIEF SUMMARY OF THE INVENTION

The important point of the present invention is the mask comprising a mask main body, a filter part and a face seal, wherein the outer periphery part of the main body and the outer periphery part of the face seal are joined, said face seal is composed of a sheet prepared by laminating soft resin such as polyurethane resin on one surface of elastic fabric made of nylon or polyester fibers, and said laminated sheet is cut off to have a modified ring shape.

That is, since the fabric composing a face seal of the mask has elasticity and polyurethane resin is laminated on it, the mask does not have gas permeability, has good touch to the face skin and can fit to the face of mask wearer. Further, because the fabric is cut out to have a modified ring shape, it can allow the easy breathing of mask wearer irrelevantly to the size and shape of the person's nose part, therefore, even if the mask is put on so long time, mask wearer does not feel stifling. And it is desirable to insert a frame along with the joining part of the mask main body or the filter part (simplified to mask main body) with the face seal because the shape of the mask can be maintained and the fitting of the mask to the face can be improved by the inserted frame.

BRIEF ILLUSTRATION OF THE DRAWINGS

1: mask

2: face seal

Figure 1:
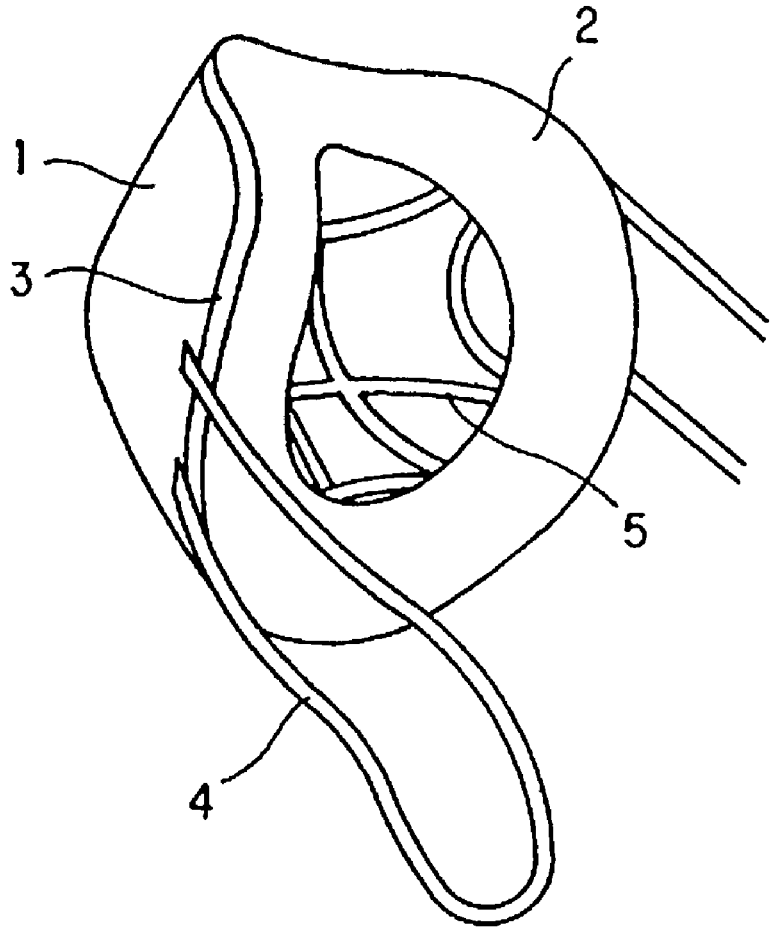
FIG. 1 is the perspective view of the mask of the present invention

3: joined part of the mask main body and the face seal

4: head harness

5: frame

6: filter

7: melt cut part

DETAIED DESCRIPTION OF THE INVENTION

The present invention will be illustrated more in detail according to the following description.

As the material for the mask main body of the present invention, the ordinary fabric which is used to these masks can be used. The function required to the mask main body is to have the filtering function, or it is required to arrange the filtering material to the mask main body. As the fabric to be used to the face seal is the sheet prepared by laminating soft resin such as polyurethane resin on one surface of elastic fabric made of nylon or polyester fibers, and the thickness of the soft resin is not restricted and is required not to have gas permeability. The thickness of the soft resin is normally from 10 to 50 μm around. According to the present invention, the touch of the mask to the face of mask wearer is excellent, because nylon fiber or polyester fiber is contacted to the face. More over, the present invention can prevent the sticky feeling caused by sweat. Since the face seal is cut off to have a modified ring shape and have a space closely to nostril, it can fit to the face irrelevantly to the shape of the face, and even if the mask is put on so long time, mask wearer does not feel stifling. The size of the face seal is from 80 to 140 mm, and this is cut off to have a ring shape. The width of the ring is approximately from 10 to 40 mm.

Therefore, the mask of the present invention can be fitted to various shapes of the face of the persons who put it on, further since the face seal moves along with the motion of the mouth at the conversation, the high air tight can be maintained always.

The mask of the present invention is characterized that the outer periphery part of the main body and the outer periphery part of the face seal are joined. Said parts can be adhered using adhesive or sewed up or joined by heat fusing, however from the view point of gas permeability, the joining by heat melting is desirably used.

Further, by inserting a frame having stereographical shape suited to the face shape along with the joining part of the mask main body with the face seal, the fitting of the face and the face seal can be improved. In general, the frame is made of a plastic resin such as polyethylene or polypropylene.

Still more, an exhaust valve can be provided to the mask main body.

The shape of the mask of the present invention is shown in FIG. 1. In FIG. 1, 1 is a mask main body and 2 is a face seal. 3 is an adhering part of the mask main body with the face seal, 4 is a head harness and 5 is a frame.

Figure 2:
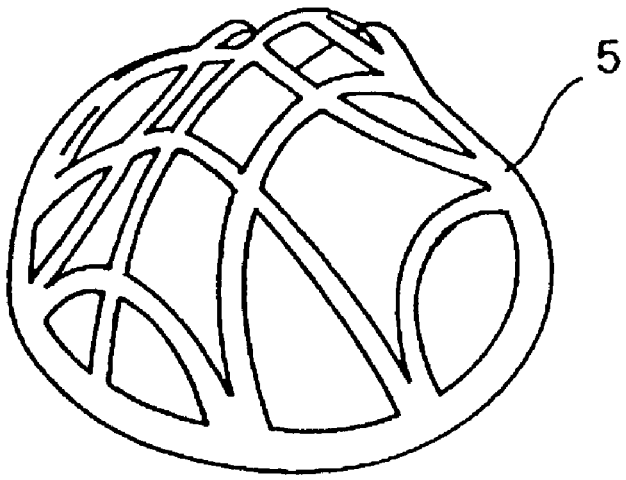
FIG. 2 is the perspective view of the frame used in the present invention

FIG. 2 is showing one example of a frame 5 having stereographical shape which can be used to the mask of the present invention.

Figure 3:
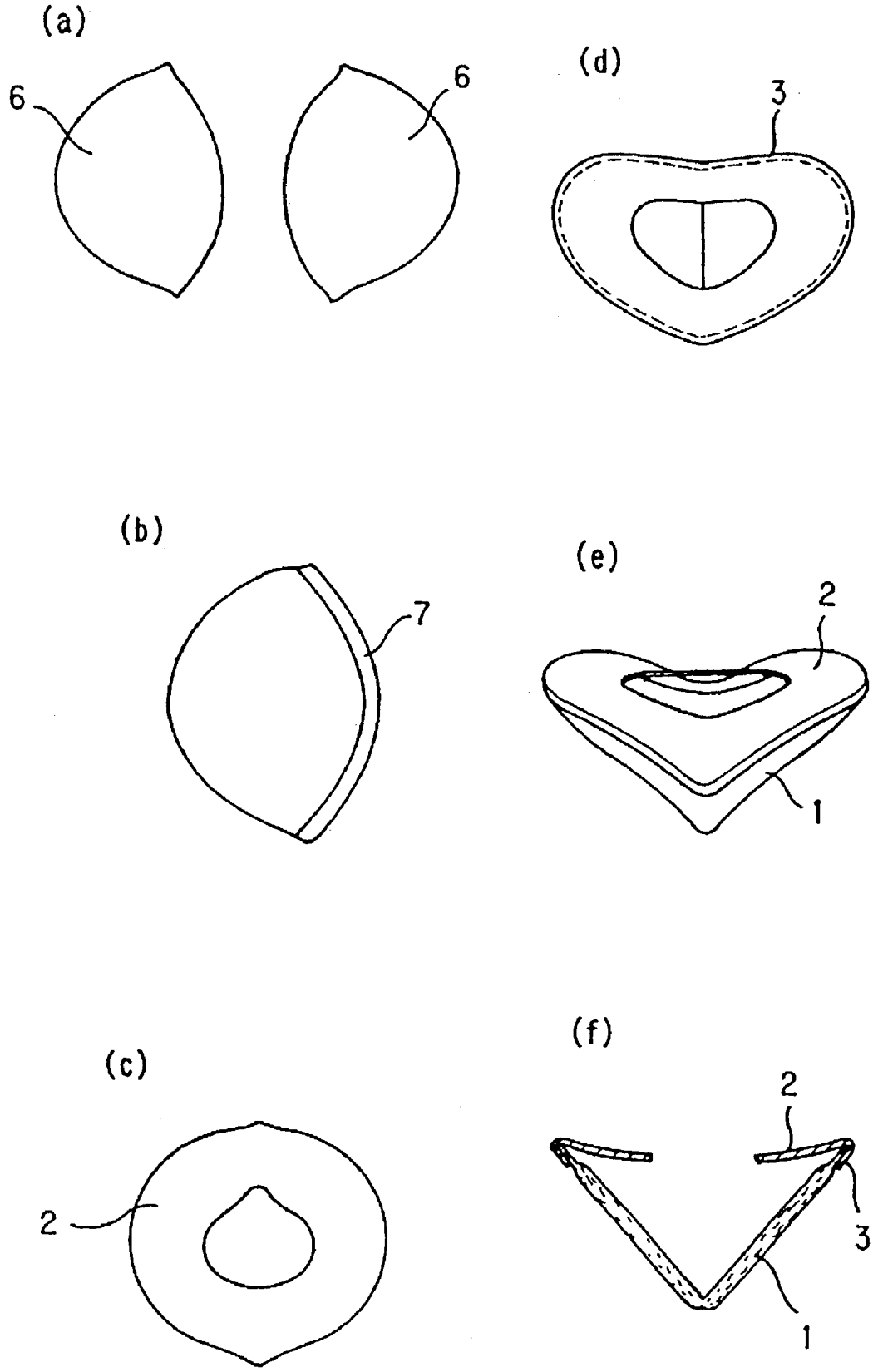
FIG. 3 is the explanatory view of the preparation process of the mask of the present invention Numerical marks in the drawing are

The preparation process of the mask of the present invention is shown in FIG. 3. Two sheets of bilateral symmetry filter material 6, 6 are piled and joined by heat melting at the center part and the mask main body 3 is formed by melt cutting (FIG. 3*a* and FIG. 3*b*). 7 shows a melt cut part. The face seal is prepared separately, namely, a face seal is formed by cutting off the fabric made of nylon or polyester fibers on one surface of which soft resin such as polyurethane resin is laminated to ring shape (FIG. 3C), and the outer periphery of the mask main body which is previously formed is joined with the outer periphery of the face seal. In FIG. 3*d*, the part surrounded by dotted line is a joining part. Then, the mask main body and the face seal are joined together with so as to form one body, and by turning over said one body the mask of the present invention is obtained. In some cases, it is not necessary to turn over said one body. In this case, the face seal does not contact to the mask main body (FIG. 3*f*).

The characteristics of the mask relating to the present invention are estimated by measuring the leakage ratio.

The method for measuring the leakage ratio is carried out according to the following procedure. Namely, persons who have specific lip width and specific distance from radix nasi to chin listed in Table 1 are selected as the testees. The testees put on the mask and breathe by the ratio of 10 times breathing per 1 minute in the atmosphere containing sodium chloride aero sol for 3 minutes. The concentration of sodium chloride in dead space of disposable type dust mask and the concentration of sodium chloride in the atmosphere containing sodium chloride aero sol are measured. The leakage ratio is calculated according to the following numerical formula.

$$\text{leakage ratio} = \frac{\text{ave. of NaCl conc. (*) in dead space in testing time} \times 2}{\text{ave. of NaCl conc. (*) in NaCl containing atmosphere}} \times 100$$

(*) $mg/m^3$

This measuring method is based on the measuring method for leakage ratio of disposable type dust mask of the disposable type dust mask standard prescribed by "Industrial Safety and Health Law".

EXAMPLE

Example 1

The measuring results by leakage ratio of the disposable type dust mask among the disposable type dust mask standard prescribed by Industrial Safety and Health Law are summarized in Table. 1.

TABLE 1

| Width of lip (cm) | Distance from radix masi to chin (cm) | Numbers of testee | Leakage ratio (%) |
|---|---|---|---|
| 3.5–4.5 | 10.5–11.5 | 1 | 0.53 |
| 3.5–4.5 | 11.5–12.5 | 1 | 0.56 |
| 3.5–4.5 | 12.5–13.5 | 1 | 0.10 |
| 4.5–5.5 | 10.5–11.5 | 1 | 0.09 |
| 4.5–5.5 | 11.5–12.5 | 1 | 0.14 |
| 4.5–5.5 | 12.5–13.5 | 1 | 0.06 |
| 5.5–6.5 | 11.5–12.5 | 1 | 0.10 |
| 5.5–6.5 | 12.5–13.3 | 1 | 0.12 |
| 5.5–6.5 | 13.5–14.5 | 1 | 0.11 |

Effect of the Invention

As mentioned above, since the face seal of the mask of the present invention is composed of elastic fabric, the touch to the face skin is very good. Further, the face seal is made of a fabric just cut off from the plane fabric, the cost for parts can be reduced. And, since the face seal does not contact to the mask main body or the mask filtering part, the area of filter can be used efficiently.

The invention claimed is:

1. A mask comprising a mask main body and a face seal, wherein an outer periphery part of the main body and an outer periphery part of the face seal are joined, said face seal being composed of soft resin such as polyurethane resin laminated on one surface of elastic fabric made of nylon fiber or polyester fiber, said face seal being cut off to have a modified ring shape wherein a frame is inserted along with a joining part of the outer periphery of mask main body and the outer periphery of the face seal.

* * * * *